US005712590A

United States Patent [19]

Dries et al.

[11] Patent Number: 5,712,590

[45] Date of Patent: Jan. 27, 1998

[54] TEMPERATURE STABILIZED BANDGAP VOLTAGE REFERENCE CIRCUIT

[76] Inventors: Michael F. Dries, 6830 Utica Ter., Chanhassen, Minn. 55317; Benjamin L. Gingerich, 9715 29th Ave. North, Plymouth, Minn. 55441

[21] Appl. No.: 576,798

[22] Filed: Dec. 21, 1995

[51] Int. Cl.[6] ..... G05F 1/10

[52] U.S. Cl. ..... 327/539; 327/538; 327/70; 327/83; 327/99; 323/313

[58] Field of Search ..... 327/70, 82, 83, 327/89, 99, 538, 540, 545, 546, 539; 323/313, 314; 365/229

[56] References Cited

U.S. PATENT DOCUMENTS

| | | | |
|---|---|---|---|
| 4,492,876 | 1/1985 | Colbert et al. | 365/229 |
| 4,617,473 | 10/1986 | Bingham | 307/66 |
| 4,752,700 | 6/1988 | Boyacigiller | 307/297 |
| 4,806,789 | 2/1989 | Sakihama et al. | 307/297 |
| 5,272,393 | 12/1993 | Horigushi et al. | 307/296.6 |
| 5,278,798 | 1/1994 | Miyawaki | 365/229 |
| 5,352,973 | 10/1994 | Audy | 323/313 |
| 5,391,980 | 2/1995 | Thiel et al. | 323/314 |
| 5,424,628 | 6/1995 | Nguyen | 323/314 |
| 5,440,224 | 8/1995 | Kimura | 323/313 |

OTHER PUBLICATIONS

"A Precision Curvature–Compensated CMOS Bandgap Reference" by Song & Gray, IEEE Journal of Solid–State Electronics, vol. SC–18, No. 6, Dec. 1983, pp. 634–643.

"A New Curvature–Corrected Bandgap Reference" by G. Meijer, et al, IEEE Journal of Solid–State Electronics, vol. SC–17, No. 6, Dec. 1982, pp. 1139–1143.

*Primary Examiner*—Timothy P. Callahan
*Assistant Examiner*—Jung Ho Kim
*Attorney, Agent, or Firm*—Gregory A. Bruns

[57] ABSTRACT

A voltage reference circuit includes at least a first and a second voltage supply having different operating temperature ranges. Output voltages of the two voltage supplies are compared and one of the supplies is selected to provide an optimum voltage reference.

15 Claims, 4 Drawing Sheets

TEMPERATURE STABILIZED BANDGAP VOLTAGE REFERENCE CIRCUIT

BACKGROUND OF THE INVENTION

This invention relates generally to Voltage Reference circuits, and more specifically to bandgap voltage reference circuits and means for reducing the voltage curvature thereof.

For data acquisition circuits, sensor buffering circuits, and various other monolithic integrated circuits, a voltage reference circuit is often required. Two types of circuits are commonly used, zener-diode reference circuits and bandgap voltage reference circuits. Bandgap reference circuits are preferable over zener-diode references because of their ability to be used in low voltage applications, their low power dissipation, and because they have good overall long term stability. Bandgap voltage reference circuits typically are designed to provide first order temperature compensation.

The Bandgap voltage reference operates by adding a differential voltage, derived from biasing two bipolar base-emitter junctions at different current densities, to a single base-emitter junction voltage. The differential voltage has a positive temperature coefficient, while the single base-emitter junction voltage has a negative temperature coefficient. By adjusting the magnitude of one of the temperature coefficient terms, and combining the two terms in an adder circuit, the output of the adder will he temperature insensitive to a first order. Even in an ideal bandgap reference however, second order curvature exists because the single base-emitter junction voltage is not linear with respect to temperature. Consequently, deviation from the nominal voltage, caused by this curvature, will define the temperature range over which the device may be used.

Various methods exist for dealing with the second order temperature effects of bandgap reference circuits, such as increasing the exponent of the bias current, or adding a higher order temperature dependent term. These two methods are discussed respectively in "*A New Curvature-Corrected Bandgap Reference*", *IEEE Journal of Solid State Circuits*, Vol. SC-17, No. 6, December 1992, and "*A Precision Curvature-Compensated CMOS Bandgap Reference*", *IEEE Journal of Solid-State Circuits*, Vol. SC-18, No. 6, December 1983. Such methods are typically complicated to implement, and difficult to adjust however.

There is a rapidly developing need for integrated circuits that can operate over a very wide temperature range, e.g., −55° C.–+300° C. Examples of applications include jet engine controls, automotive engine controls, down-hole oil drilling, logging and monitoring, aerospace and military. Thus, a need exists for an accurate reference voltage circuit that will operate over a wide range of temperatures.

SUMMARY OF THE INVENTION

The present invention solves these and other needs by providing a voltage reference circuit which includes two or more voltage supply circuits. Each supply circuit compensates for first order temperature effects. Each supply is optimally compensated over a different temperature range. Some overlap of the optimal temperature range of the two supplies is provided so that an extended contiguous optimum temperature range can be created by using two supplies. To combine the voltage reference output from the two supplies, a comparator circuit is used. The comparator circuit provides an output which indicates which voltage supply circuit is operating within its optimum temperature range. Select circuits are provided which use the output of the comparator to select the voltage supply circuit operating in its optimal range, and couple that supply to the output of the voltage reference circuit. In the preferred embodiment, the output is buffered through an op-amp, and a hysteresis method is provided to prevent the overall circuit from oscillating when the device is operating at the switching point of the comparator.

DETAILED DESCRIPTION OF THE PREFERRED EMBODIMENT

Figure 1:
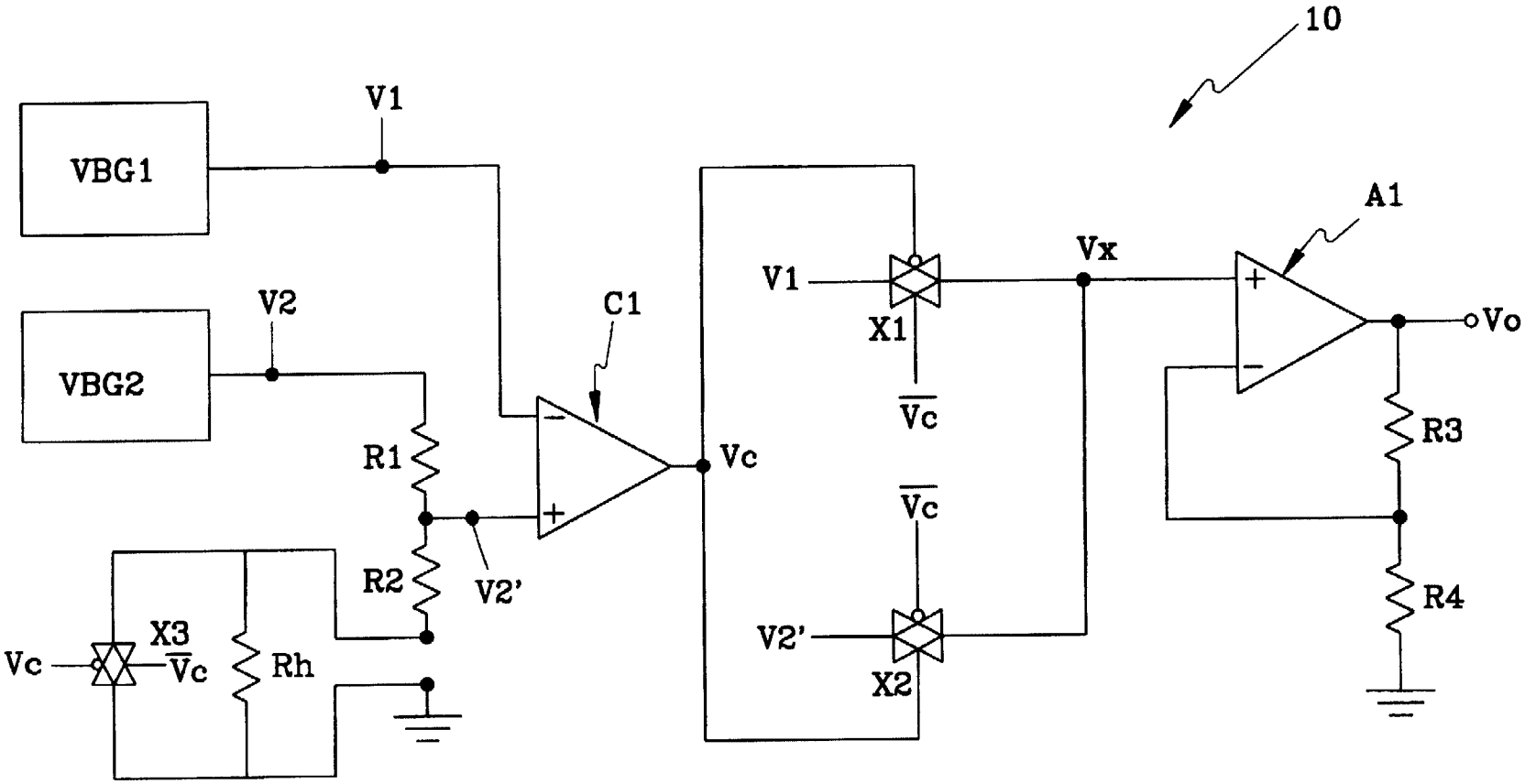
FIG. 1 is a schematic diagram showing a voltage reference circuit according to the teachings of the present invention.
Figure 2:
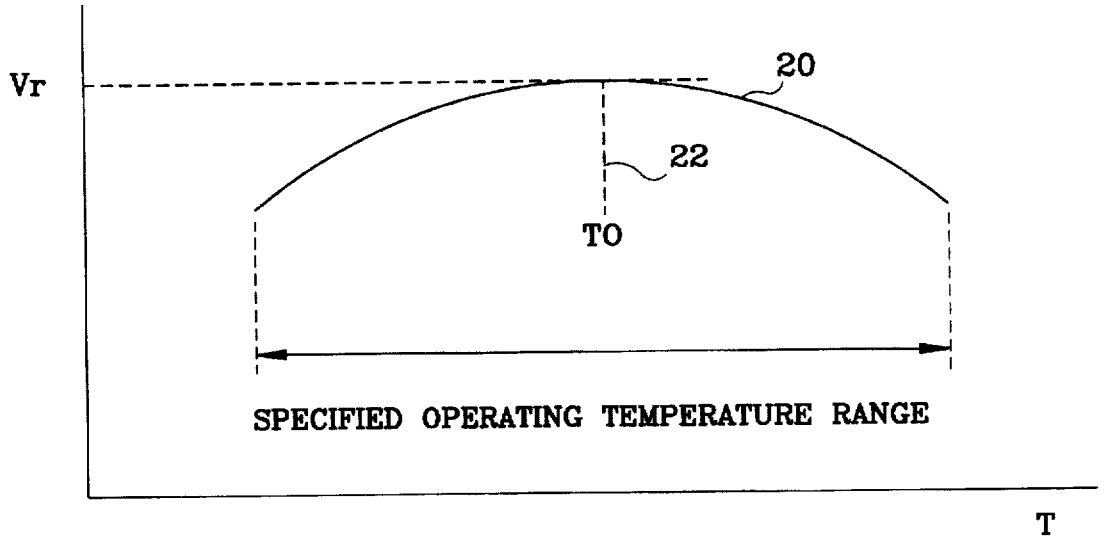
FIG. 2 shows the bandgap voltage vs. temperature curve for a typical Bandgap Voltage Reference as found in the prior art.

A preferred embodiment of the voltage reference circuit is shown in FIGS. 1 and 2. The embodiment utilizes two bandgap voltage reference circuits or supplies, VBG1 and VBG2. A typical voltage vs. temperature graph for a first order corrected VBG1 or VBG2 is shown in FIG. 2. Note that graph 20 increases with increasing temperature, reaches a maximum at 22 and then decreases. Graph 20 is generally symmetrical about maximum temperature $T_O$ 22.

Figure 3:
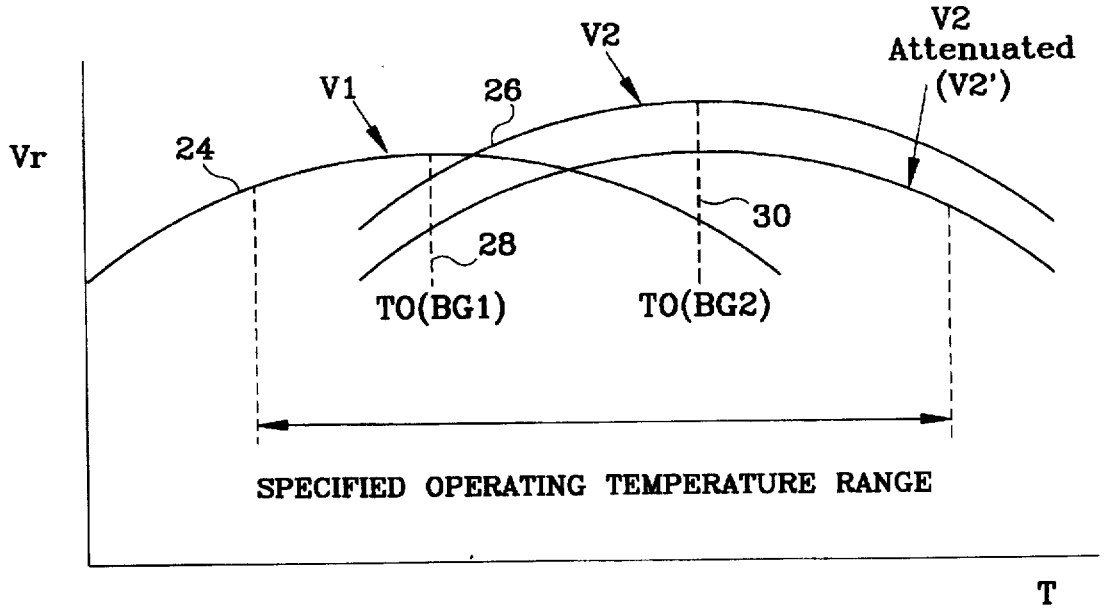
FIG. 3 shows the relationship between the voltage vs. temperature curves of two Bandgap Voltage Supplies of FIG. 1.

The outputs of VBG1 and VBG2 are V1 and V2 respectively. VBG1 and VBG2 are designed to provide the characteristic voltage vs. temperature curves 24 and 26 as shown in FIG. 3 where curve 24 increases with increasing temperatures, reaches a maximum at 28 and then decreases. Curve 26 begins at a temperature below 28, increases to a maximum at 30 and then decreases. V1 would typically have a different maximum voltage than V2. The output of VBG1, is connected to one input of a comparator C1, and to the input of a transmission gate X1.

The output of VBG2 is connected to one side of a resistor R1. The second side of resistor R1 is connected to the positive input of comparator C1, resistor R2, and the input of a transmission gate X2. The other side of resistor R2 is connected to one side of resistor Rh and the transmission gate X3. The second side of Rh and X3 are connected to ground. Transmission gates X1, X2 and X3 have an input, an output, a select line, and a NOTed select line.

Resistors R1 and R2 are provided to attenuate the voltage V2 so that the maximum voltages of the two inputs to the comparator (C1) are approximately equal:

$$V2\left[\frac{R2}{R1+R2}\right]=V1=V2'$$

this will occur at different temperatures [$T_O$ (BG1) and $T_O$ (BG2)] as shown in FIG. 3.

Comparator C1 is adjusted to provide a low output when VBG1 is providing an optimum voltage reference signal, and to provide a high output when VBG2 is providing an optimum voltage reference signal.

Output Vc of comparator C1 is connected to the NOTed select line of X1, and the select line of X2. The outputs of both X1 and X2 are connected to the positive input of an op-amp, A1. In the preferred embodiment, op-amp A1 provides the final output, $V_o$, of the reference circuit, Vo. This output voltage may be made adjustable, as is known in the art. One such example is shown in FIG. 1. A resistor R3 is added between Vo and the negative input of op-amp A1, and a resistor R4 is added between the negative input of op-amp A1 and ground. As with R1 and R2, since the attenuator is ratiometric, the absolute temperature coefficients of resistors R3 and R4 will not degrade the temperature independence of the circuit.

In operation, when the temperature is such that VBG1 is providing an optimum voltage reference value, comparator C1 will output a low value, X1 will be turned on, and X2 will be turned off. Consequently, voltage V1 from VBG1 will be passed through to Vx and to op-amp A1 which will amplify V1, and provide an amplified V1 as the output Vo.

Figure 5:
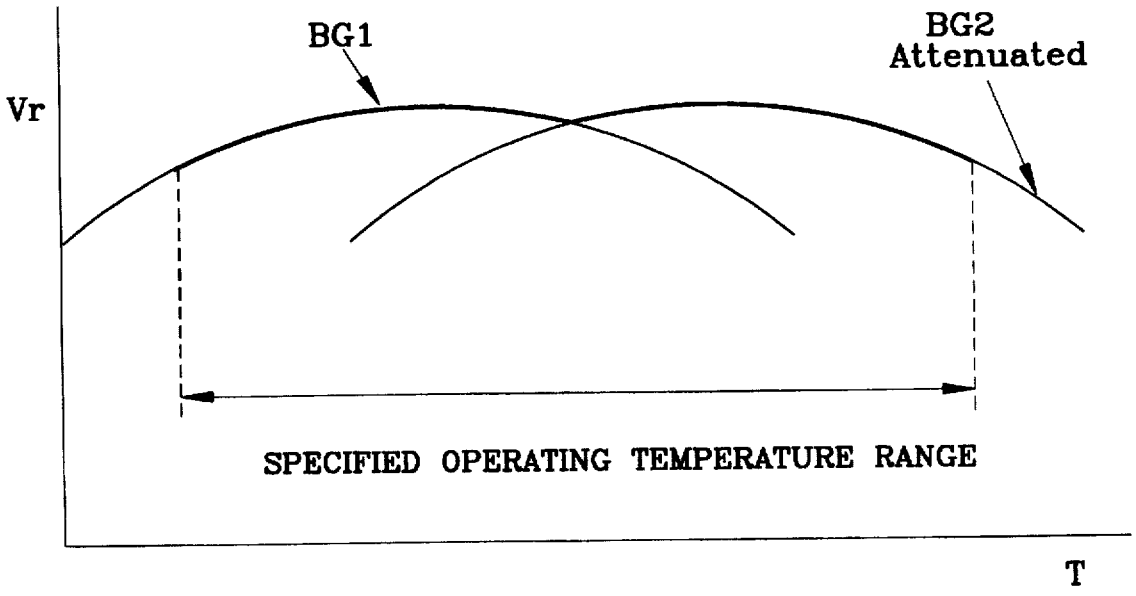
FIG. 5 shows the overall output of the voltage reference circuit of FIG. 1.

On the other hand, when the temperature is such that VBG2 is providing an optimum voltage reference value, comparator C1 will output a high value, X1 will be turned off, and X2 will be turned on. Consequently, voltage V2' from VBG2 will be passed through to Vx and to op-amp A1, which will amplify V2' and provide an amplified V2' as output Vo. The voltage vs. temperature graph for the dual bandgap circuit will consequently appear as shown by the heavy curve in FIG. 5.

To insure that the circuit does not oscillate when the ambient temperature is such that V1=V2', hysteresis is employed. A small resistor Rh, is connected in series with resistor R2 as shown in FIG. 1. The NOTed select line of transmission gate X3 is controlled by output Vc of comparator C1. Any offset in the comparator can be compensated for with proper adjustment of resistors R1 and R2. Since the attenuator is ratiometric, the absolute temperature coefficients of resistors R1, R2 and Rh will not degrade the temperature independence of the circuit.

When Rh and X3 have been added to the circuit, transmission gate X3 will close when the output of C1 goes low, and the current passing through R2 will not pass through Rh but will pass through X3 (which has a much lower impedance than Rh) to ground. When the output of C1 goes high, transmission gate X3 will open and the current passing through R2 will also pass through Rh. This causes a higher voltage to be seen at the input of comparator C1. Consequently, comparator C1 will not go low again until V2' is lower by an amount equal to the current now flowing through Rh, times Rh. This hysteresis or differential effect prevents oscillation when the circuit temperature lies at the border between VBG1 and VBG2s' temperature range, i.e., V1 and V2' are approximately equal.

Figure 4:
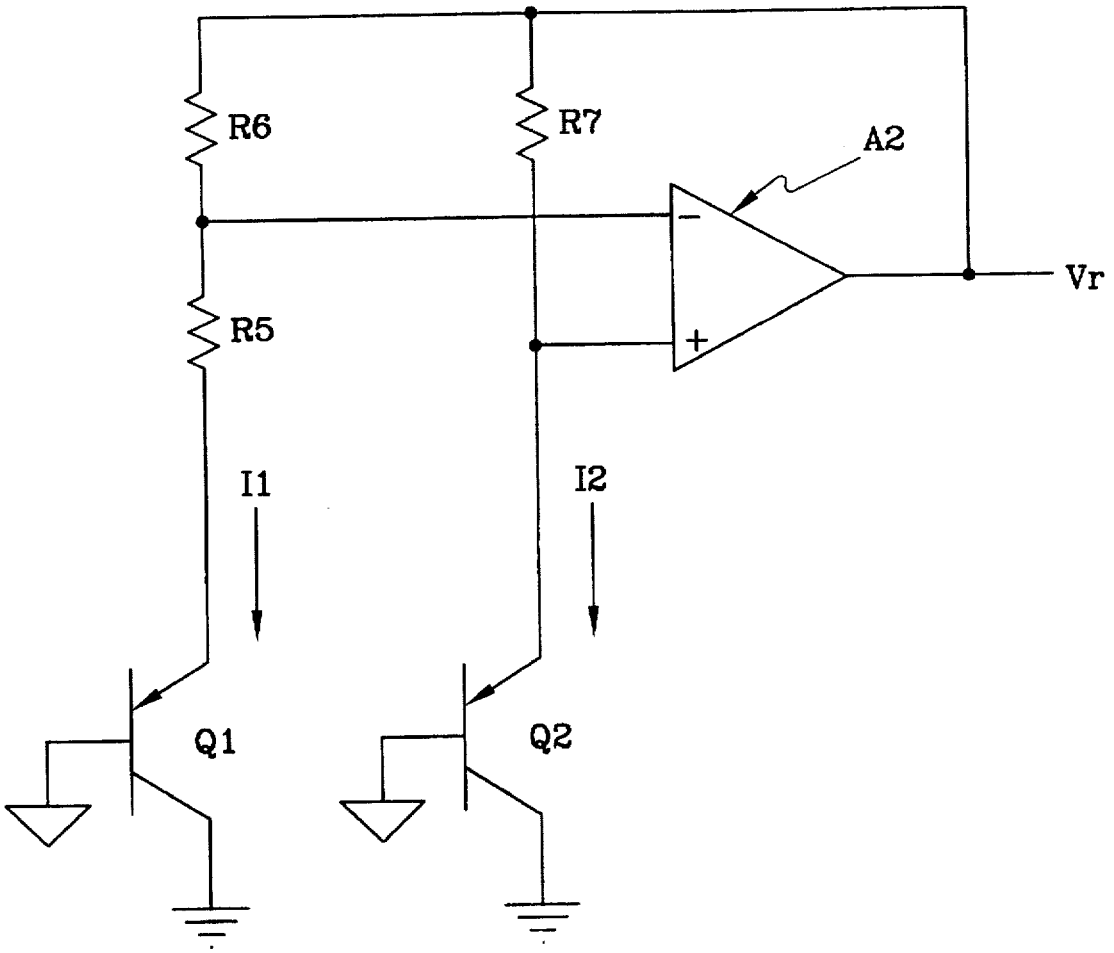
FIG. 4 shows one implementation of a single Bandgap Voltage supply which could be used in the invention.

One implementation of a circuit for each of VBG1 and VBG2 is shown in FIG. 4. Two p-type transistors, Q1 and Q2 are provided such that the emitter area of Q1 is not equal to the area of Q2. For both transistors, the base and collectors are tied to ground. The emitter of Q1 receives a current I1, and is connected to a resistor R5. The other side of R5 is connected to a resistor R6, and the negative input of an op-amp A2. The emitter of Q2 receives a current I2, and is connected to the positive input of op-amp A2, and to one side of a resistor R7. The second side of R7 is connected to the second side of R6, and output Vr of op-amp A2. The base and collector of Q1 and Q2 are grounded.

In operation, the base to emitter voltages of Q1 and Q2 are:

$$VbeQ1=Vt * ln(I1/C1) \text{ and}$$

$$VbeQ2=Vt * ln(I2/C2),$$

where Vt=kT/q, and C1 and C2 are constants proportional to transistor areas of Q1 and Q2 respectively. Since op-amp A2 will force the voltage on its two inputs to be equal, assuming no offset voltage, the voltage on the negative input of op-amp A2 will be equal to VbeQ2 and:

$$I1=(Vr-VbeQ1)/R5+R6, \text{ also,}$$

$$I1=(VbeQ1-VbeQ2)/R2/=\blacktriangle Vbe/R1, \text{ so that:}$$

$$\blacktriangle Vbe/R1=(Vr-VbeQ1)/R5+R6 \text{ or:}$$

$$Vr=VbeQ1+\blacktriangle Vbe\ (R6/R5+1).$$

In this way, the output Vr will reflect the positive temperature coefficient of the ▲Vbe term, and the negative temperature coefficient of the VbeQ1 term. Adjustments in R5 and R6 can be used to cause an exact cancellation of the VbeQ1 term with the ▲Vbe term at a first selected temperature for VBG1. A second circuit is then configured for VBG2 that provides cancellation of the VbeQ1 term with the ▲Vbe term at a second selected temperature.

It is apparent that there has been provided, in accordance with the present invention, a means for providing an improved low temperature coefficient voltage reference circuit. Additionally, the present invention does not require the complicated implementations or difficult adjustments of methods which compensate directly for second order effects.

Although the preferred embodiment has been described in detail, it should be understood that various changes, substitutions, and alterations can be made herein. For example, Zener references, or a combination of Zener and Bandgap References, or any pair of reference curves that have maxima or minima points in their v vs. TEMP curves, could be used, instead of only Bandgap References without loosing the benefits and advantages of the present invention. Also, while the preferred embodiment, refers to two voltage reference circuits, similar advantages would also be achieved with three four or any multiple of voltage reference sources. These and other examples are readily ascertainable by one skilled in the art and could be made without departing from the spirit and scope of the present invention as defined by the following claims.

We claim:

1. A temperature-stabilized voltage reference circuit comprising:

at least a first and a second voltage reference circuit, said first voltage reference circuit having a first operating temperature range extending from a first temperature to a second temperature and providing a first voltage, with said first voltage varying with temperature and passing through a maximum value or a minimum value within said first operating temperature range;

said second voltage reference circuit having a second operating temperature range extending from a third temperature to a fourth temperature, with said third temperature lying between said first temperature and said second temperature, and providing a second voltage, with said second voltage varying with temperature and passing through a maximum value or a minimum value within said second operating temperature range; and means for selectively coupling one of said first voltage or said second voltage to an output of said temperature-stabilized voltage reference circuit based on a value of temperature and whether said value is increasing or decreasing.

2. Circuit of claim 1 wherein said means for coupling comprises:

comparator means for comparing said first voltage to said second voltage and providing a comparator output at a first level when said first voltage exceeds said second voltage and at a second level when said second voltage exceeds said first voltage; and selection means coupled to said comparator output for coupling said first voltage or said second voltage to said output.

3. Circuit of claim 2 wherein said comparator has a switching point circuit further comprising:

a hysteresis means to prevent oscillation of said comparator means when said first voltage is approximately equal to said second voltage.

4. Voltage reference circuit of claim 2 further comprising a selectable gain buffer coupled between said selection means and said output of the temperature-stabilized voltage reference circuit.

5. A temperature-stabilized voltage reference circuit comprising:

a first bandgap voltage reference circuit having a first output voltage that increases with temperature, reaches a maximum first voltage at a first temperature, and then decreases;

a second bandgap voltage reference circuit having a second output voltage that increases with temperature, reaches a maximum second voltage at a second temperature, and then decreases;

means for adjusting said second maximum voltage to be equal to said first maximum voltage;

means for comparing said first output voltage to an adjusted second output voltage and providing a first level output when said first output voltage exceeds said adjusted second output voltage and a second level output when said adjusted second output voltage exceeds said first output voltage;

means for coupling said first output voltage to an output of said temperature-stabilized voltage reference circuit when said means for comparing is providing said first level output, and for coupling said adjusted second output voltage to said output of said temperature-stabilized voltage reference circuit when said means for comparing is providing said second level output.

6. Circuit of claim 5 wherein said means for adjusting comprises;

a first resistance means and a second resistance means having a series connection between said second output voltage and ground, with said adjusted second output voltage taken at said series connection.

7. Circuit of claim 6 wherein said means for coupling comprises;

a first transmission gate coupled to said first output voltage and to said means for comparing; and a second transmission gate coupled to said adjusted second output voltage and to said means for comparing.

8. Circuit of claim 7 further comprising:

hysteresis means for preventing rapid changes between said first level output and said second level output when said first output voltage and said adjusted second output voltage are approximately equal.

9. Circuit of claim 8 wherein said hysteresis means comprises means for connecting a third resistance means between said second resistance means and ground when said means for comparing is providing a second level output.

10. Circuit of claim 8 further comprising a selectable gain buffer coupled between said means for coupling and said output of said temperature-stabilized voltage reference circuit.

11. Circuit of claim 5 wherein said first temperature and said second temperature are selected to provide a continuous operating temperature range of said temperature-stabilized voltage reference circuit.

12. Circuit of claim 11 wherein said continuous operating temperature range includes temperatures from −55° C. to 300° C.

13. A method for generating a temperature-stabilized reference voltage, comprising the steps of:

generating a first bandgap voltage which inherently varies over a first temperature range;

generating a second bandgap voltage which inherently varies over a second temperature range;

adjusting a maximum of said second bandgap voltage to be equal to a maximum of said first bandgap voltage;

comparing said first bandgap voltage to said second bandgap voltage; and selecting the higher of said first bandgap voltage and said second bandgap voltage; and providing said selected voltage as said reference voltage.

14. Method of claim 13 wherein said step of comparing comprises the step of adjusting a maximum of said second voltage to be equal to a maximum of said first voltage.

15. Method of claim 13 wherein said step of comparing comprises providing a hysteresis effect for said selected voltage to prevent oscillation of selection between said first and second voltages.

* * * * *